US010415855B2

(12) United States Patent
Kawano et al.

(10) Patent No.: US 10,415,855 B2
(45) Date of Patent: Sep. 17, 2019

(54) REFRIGERATION CYCLE APPARATUS

(71) Applicant: Panasonic Intellectual Property Management Co., Ltd., Osaka (JP)

(72) Inventors: Bunki Kawano, Osaka (JP); Tomoichiro Tamura, Kyoto (JP); Iori Maruhashi, Osaka (JP); Michiyoshi Kusaka, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 36 days.

(21) Appl. No.: 15/404,149

(22) Filed: Jan. 11, 2017

(65) Prior Publication Data

US 2017/0227258 A1 Aug. 10, 2017

(30) Foreign Application Priority Data

Feb. 4, 2016 (JP) ..... 2016-019980

(51) Int. Cl.
*F25B 1/10* (2006.01)
*F25B 43/00* (2006.01)

(52) U.S. Cl.
CPC ..... *F25B 1/10* (2013.01); *F25B 43/00* (2013.01); *F25B 2400/072* (2013.01); *F25B 2400/23* (2013.01)

(58) Field of Classification Search
CPC ..... F25B 1/10; F25B 43/00; F25B 2400/23; F25B 2400/072
USPC ..... 62/510
See application file for complete search history.

(56) References Cited

U.S. PATENT DOCUMENTS 2,799,142 A * 7/1957 Schubert ..... F25B 5/00 62/114
4,303,427 A * 12/1981 Krieger ..... F25B 1/10 62/335
4,554,799 A * 11/1985 Pallanch ..... F25B 1/10 417/243
4,745,777 A * 5/1988 Morishita ..... F04C 18/0215 62/509

(Continued)

FOREIGN PATENT DOCUMENTS

CN 104235988 A 12/2014
JP 2008-122012 5/2008

OTHER PUBLICATIONS

The Extended European Search Report dated Jun. 6, 2017 for the related European Patent Application No. 17151921.8.

*Primary Examiner* — Ljiljana V. Ciric
(74) *Attorney, Agent, or Firm* — McDermott Will & Emery LLP

(57) ABSTRACT

A refrigeration cycle apparatus includes an evaporator, a first compressor, an intercooler, a second compressor, a condenser, and a refrigerant liquid supply passage. The intercooler stores refrigerant liquid and also cools refrigerant vapor compressed by the first compressor and expels it. The second compressor sucks in the refrigerant vapor expelled from the intercooler and compresses it. The intercooler includes a container, an intercooling passage, and a pump. The container contains a vapor space and stores refrigerant liquid. The intercooling passage is a passage in which a part of the refrigerant liquid stored in the container flows and that supplies the part of the refrigerant liquid to the vapor space. The pump pumps a part of the refrigerant liquid stored in the container to the vapor space.

8 Claims, 5 Drawing Sheets

(56) References Cited

U.S. PATENT DOCUMENTS

| | | | | | |
|---|---|---|---|---|---|
| 4,787,211 | A * | 11/1988 | Shaw | F25B 1/10 | 417/248 |
| 4,896,515 | A * | 1/1990 | Endou | F25B 1/10 | 62/498 |
| 4,947,655 | A * | 8/1990 | Shaw | F25B 1/10 | 62/200 |
| 10,260,779 | B2 * | 4/2019 | Lingelbach | F25B 1/10 | |
| 2006/0086110 | A1 * | 4/2006 | Manole | F25B 1/10 | 62/175 |
| 2008/0256975 | A1 * | 10/2008 | Lifson | F25B 1/10 | 62/510 |
| 2013/0031920 | A1 * | 2/2013 | Togano | F25B 1/053 | 62/115 |
| 2014/0047862 | A1 * | 2/2014 | Tamura | F25B 1/10 | 62/510 |
| 2014/0053597 | A1 * | 2/2014 | Matsuura | F25B 1/00 | 62/510 |
| 2015/0143826 | A1 * | 5/2015 | Lingelbach | F25B 1/10 | 62/81 |

* cited by examiner

REFRIGERATION CYCLE APPARATUS

BACKGROUND

1. Technical Field

The present disclosure relates to a refrigeration cycle apparatus.

2. Description of the Related Art

A refrigeration cycle apparatus with multiple compressors arranged in series is known. For instance, as shown in FIG. 5, Japanese Unexamined Patent Application Publication No. 2008-122012 describes an evaporative refrigeration apparatus 300 having a centrifugal compressor 315 and a Roots compressor 316 disposed in series. The centrifugal compressor 315 is located in an upstream stage and the Roots compressor 316 is located in a downstream stage.

The evaporative refrigeration apparatus 300 also includes an evaporator 301, a circulating pump 302, a conduit 303, a load 304, a conduit 305, a condenser 306, a vapor duct 307, and a vapor cooler 317. The evaporator 301 brings evaporative liquid such as water to a boil to make it evaporate under a reduced pressure lower than the atmospheric pressure. Water at a reduced temperature due to boiling and evaporation in the evaporator 301 is then pumped out by the circulating pump 302 and delivered to the load 304 through the conduit 303 to be used for air conditioning. Vapor in saturation generated in the evaporator 301 is first sucked into the centrifugal compressor 315 and compressed in it. The vapor compressed in the centrifugal compressor 315 is then sucked into and compressed by the Roots compressor 316, after which it is directed to the condenser 306.

The vapor cooler 317 is located at a position between the centrifugal compressor 315 and the Roots compressor 316 on the vapor duct 307. The vapor cooler 317 cools the vapor compressed by the centrifugal compressor 315 from superheated vapor state to saturated vapor state or cools the vapor close to saturated vapor state. Such cooling is done by directly spraying water into the vapor or by causing indirect heat exchange between the vapor and atmospheric air or cooling water.

SUMMARY

The technique described in Japanese Unexamined Patent Application Publication No. 2008-122012 leaves room for improvement in terms of enhancing the coefficient of performance (COP) of the apparatus. One non-limiting and exemplary embodiment provides a refrigeration cycle apparatus that is advantageous for achieving high COP.

In one general aspect, the techniques disclosed here feature a refrigeration cycle apparatus including: an evaporator that stores a refrigerant liquid and that evaporates the refrigerant liquid to generate a refrigerant vapor, the refrigerant liquid being a refrigerant in a liquid phase, the refrigerant vapor being the refrigerant in a vapor phase; a first compressor that compresses the refrigerant vapor generated in the evaporator; an intercooler that cools the refrigerant vapor compressed by the first compressor; a second compressor that compresses the refrigerant vapor cooled by the intercooler; a condenser that condenses the refrigerant vapor compressed by the second compressor to generate a refrigerant liquid and that stores the refrigerant liquid generated in the condenser; and a refrigerant liquid supply passage in which the refrigerant liquid stored in the condenser flows from the condenser to the evaporator, in which the intercooler includes: a container that contains a vapor space therein for receiving the refrigerant vapor compressed by the first compressor and that stores a refrigerant liquid; an intercooling passage in which a part of the refrigerant liquid stored in the container flows and that supplies the part of the refrigerant liquid stored in the container to the vapor space; and a pump that is disposed on the intercooling passage and that pumps the part of the refrigerant liquid stored in the container to the vapor space, and the intercooler makes the refrigerant liquid stored in the container directly contact the refrigerant vapor compressed by the first compressor to cool the refrigerant vapor compressed by the first compressor.

The refrigeration cycle apparatus can achieve high COP.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Figure 1:
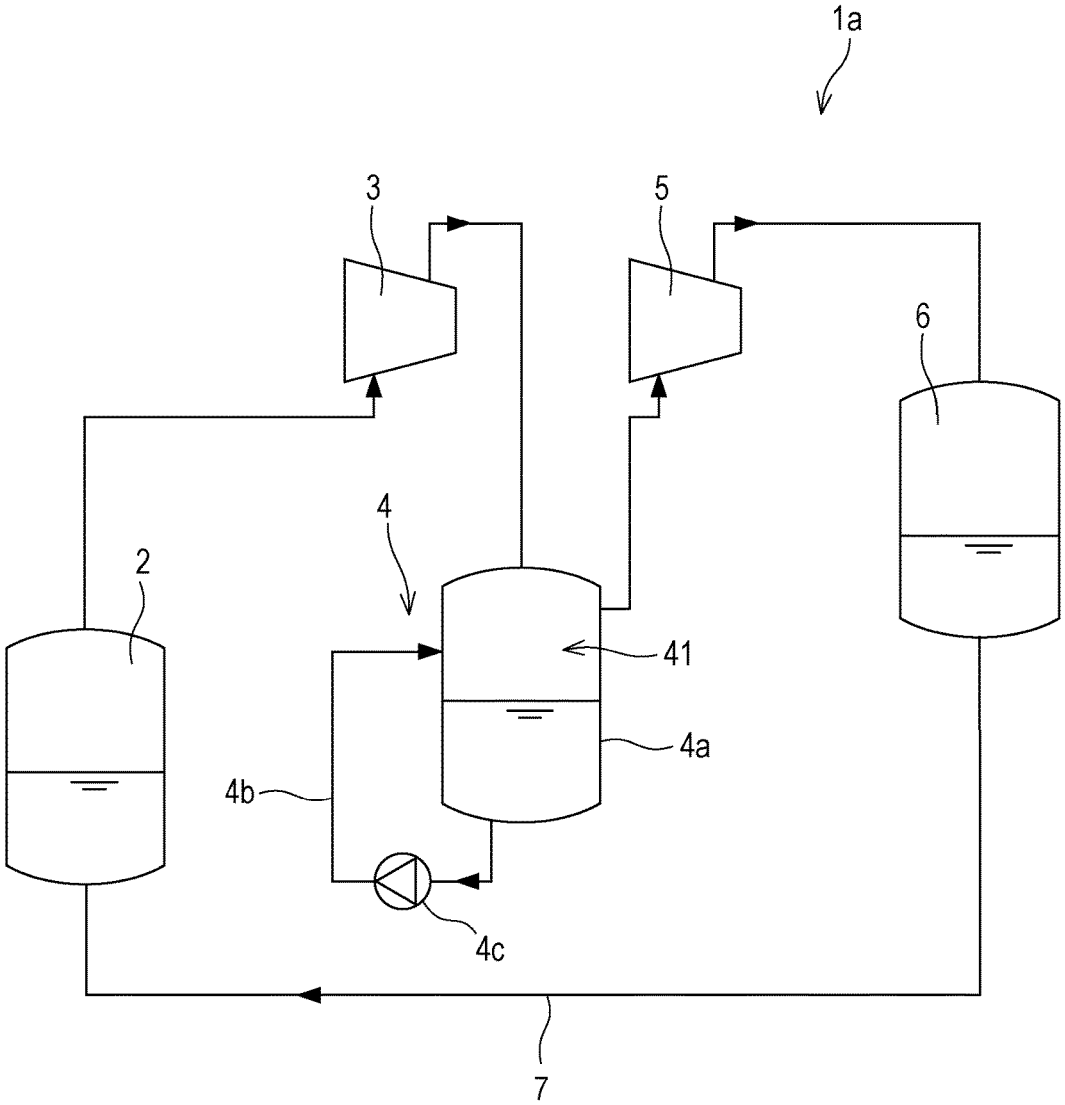
FIG. 1 shows a configuration of the refrigeration cycle apparatus according to a first embodiment of the present disclosure.

Underlying Knowledge Forming Basis of the Present Disclosure

Japanese Unexamined Patent Application Publication No. 2008-122012 has no mention of a source of the cooling water used for cooling vapor in the vapor cooler 317. If the cooling water for cooling vapor in the vapor cooler 317 is to be covered by water present in the evaporative refrigeration apparatus 300, there would be no choice but to use the water present in the evaporator 301. This is because water having a temperature below the saturation temperature at an intermediate pressure equivalent to the pressure of vapor in the vapor cooler 317 is present only in the evaporator 301. However, if water present in the evaporator 301 is utilized as cooling water for cooling vapor in the vapor cooler 317 and then returned to the evaporator 301, the amount of vapor that is generated in the evaporator 301 would increase due to the heat received by cooling water from vapor in the vapor cooler 317. This leads to increase in the mass flow rate of vapor in the centrifugal compressor 315 and the Roots compressor 316. Consequently, work that should be done by the centrifugal compressor 315 and Roots compressor 316 increases even though the temperature of vapor sucked into the Roots compressor 316 can be decreased to the saturation temperature by the vapor cooler 317. As a result, the COP that can be achieved by the evaporative refrigeration apparatus 300 would decrease.

As opposed to this, the present inventors have found out that by improving the intercooler, refrigerant vapor can be appropriately cooled in the intercooler while preventing increase in the mass flow rate of refrigerant vapor in compressors. It has been also found out that this can enhance the COP of the refrigeration cycle apparatus. The refrigeration cycle apparatus according to the present disclosure has been devised based on such findings by the inventors. The aforementioned modifications relating to the evaporative refrigeration apparatus 300 are based on consideration by the present inventors and are not meant to be admitted as conventional art.

A first aspect of the present disclosure provides a refrigeration cycle apparatus including:

an evaporator that stores a refrigerant liquid and that evaporates the refrigerant liquid to generate a refrigerant vapor, the refrigerant liquid being a refrigerant in a liquid phase, the refrigerant vapor being the refrigerant in a vapor phase;

a first compressor that compresses the refrigerant vapor generated in the evaporator;

an intercooler that cools the refrigerant vapor compressed by the first compressor;

a second compressor that compresses the refrigerant vapor cooled by the intercooler;

a condenser that condenses the refrigerant vapor compressed by the second compressor to generate a refrigerant liquid and that stores the refrigerant liquid generated in the condenser; and a refrigerant liquid supply passage in which the refrigerant liquid stored in the condenser flows from the condenser to the evaporator, in which the intercooler includes:

a container that contains a vapor space therein for receiving the refrigerant vapor compressed by the first compressor and that stores a refrigerant liquid;

an intercooling passage in which a part of the refrigerant liquid stored in the container flows and that supplies the part of the refrigerant liquid stored in the container to the vapor space; and a pump that is disposed on the intercooling passage and that pumps the part of the refrigerant liquid stored in the container to the vapor space, and the intercooler makes the refrigerant liquid stored in the container directly contact the refrigerant vapor compressed by the first compressor to cool the refrigerant vapor compressed by the first compressor.

Differently represented, the first aspect of the present disclosure provides a refrigeration cycle apparatus including:

a passage in which a refrigerant flows;

an evaporator that is present on the passage;

a first compressor that is present on the passage;

an intercooler that is present on the passage; and a second compressor that is present on the passage, in which the evaporator, the first compressor, the intercooler, and the second compressor are present in the passage in this order, the intercooler includes:

a container;

a first passage that connects a first portion of the container with the second portion of the container; and a pump that is present on the first passage, the container stores a refrigerant liquid, the refrigerant liquid being the refrigerant in a liquid phase, the first portion of the container is in contact with the refrigerant liquid, the second portion of the container is located above the first portion in the gravity direction and is not in contact with the refrigerant liquid, the pump pumps the refrigerant liquid from the first portion toward the second portion, and the intercooler makes the refrigerant liquid stored in the container directly contact a refrigerant vapor compressed by the first compressor to cool the refrigerant vapor compressed by the first compressor, the refrigerant vapor being the refrigerant in a vapor phase.

According to the first aspect, the refrigerant liquid stored in the container of the intercooler takes on the saturation temperature at the pressure of refrigerant vapor received into the intercooler. This is because the refrigerant liquid takes on the saturation temperature at the pressure of the refrigerant vapor received in the intercooler due to phase change of refrigerant caused by the difference between the saturation pressure at the temperature of refrigerant liquid and the pressure of refrigerant vapor in the intercooler. Refrigerant vapor in superheated state expelled from the first compressor is cooled by directly contacting refrigerant liquid at the saturation temperature, and the refrigerant liquid evaporates by receiving the heat of the refrigerant vapor. The refrigerant vapor thus generated is sucked into the second compressor. Because the refrigerant liquid stored in the evaporator is not supplied to the intercooler and no increase in the mass flow rate of refrigerant vapor in the first compressor is caused by the intercooler, it is possible to prevent increase of the work to be done by the first compressor. Additionally, refrigerant vapor can be cooled by the intercooler such that the refrigerant vapor sucked into the second compressor is at the saturation temperature or a temperature in the neighborhood of the saturation temperature. As a result, the refrigeration cycle apparatus according to the first aspect can achieve high COP.

A second aspect of the present disclosure provides a refrigeration cycle apparatus that further includes a replenishing channel in which a part of the refrigerant liquid stored in the condenser flows and that supplies the part of the refrigerant liquid stored in the condenser into the container, in addition to the components of the first aspect. According to the second aspect, a part of the refrigerant liquid stored in the condenser flows through the replenishing channel to be supplied into the container of the intercooler and also flash evaporates into refrigerant liquid and refrigerant vapor having the saturation temperature at the pressure of the refrigerant vapor received into the intercooler. The refrigerant vapor thus generated is sucked into the second compressor. This can keep the refrigerant liquid stored in the intercooler at the saturation temperature without increasing the work to be done by the first compressor and also prevent shortage of the amount of refrigerant liquid stored in the intercooler. Thus, the work to be done by the first compressor is not increased even when the refrigeration cycle apparatus is operated for a long period of time. In addition, refrigerant vapor can be cooled by the intercooler so that the refrigerant vapor sucked into the second compressor is at the saturation temperature or a temperature in the neighborhood of the saturation temperature. As a result, the refrigeration cycle apparatus according to the second aspect can achieve high COP.

A third aspect of the present disclosure provides a refrigeration cycle apparatus in which the refrigerant liquid supply passage includes a first refrigerant channel in which the refrigerant liquid discharged from the condenser flows and that supplies the refrigerant liquid discharged from the condenser into the container, and a second refrigerant channel in which a part of the refrigerant liquid stored in the container flows and that supplies the part of the refrigerant liquid to the evaporator, in addition to the components of the first aspect. According to the third aspect, the enthalpy of the refrigerant liquid that is supplied to the evaporator through the refrigerant liquid supply passage can be decreased, thus reducing the amount of refrigerant vapor generated in the evaporator. This results in decrease of the amount of superheated refrigerant vapor that is received into the intercooler from the first compressor as well as the amount of refrigerant vapor generated in the intercooler. This can reduce the work to be done by the second compressor while preventing increase of the work to be done by the first compressor. In addition, refrigerant vapor can be cooled so that the refrigerant vapor sucked into the second compressor is at the saturation temperature or a temperature in the neighborhood of the saturation temperature. As a result, the refrigeration cycle apparatus according to the third aspect can achieve high COP.

A fourth aspect of the present disclosure provides a refrigeration cycle apparatus in which the second refrigerant channel includes an upstream channel that is formed of a portion of the intercooling passage which extends from an inlet of the intercooling passage to a branching point located between a discharge port of the pump and an outlet of the intercooling passage, and a downstream channel in which a part of the refrigerant liquid flowing on the intercooling passage from the branching point flows and that supplies the part of the refrigerant liquid to the evaporator, in addition to the components of the third aspect. According to the fourth aspect, supply of refrigerant liquid to the evaporator is facilitated by the discharge pressure of the pump even when the difference between the pressure of the refrigerant vapor in the intercooler and the pressure of refrigerant vapor in the evaporator is small. Thus, the work to be done by the second compressor can be reduced while preventing increase in the work to be done by the first compressor even when the amount of heat absorption in the evaporator of the refrigeration cycle apparatus is small. In addition, refrigerant vapor can be cooled so that the refrigerant vapor sucked into the second compressor is at the saturation temperature or a temperature in the neighborhood of the saturation temperature. As a result, the refrigeration cycle apparatus according to the fourth aspect can achieve high COP.

A fifth aspect of the present disclosure provides the refrigeration cycle apparatus described in any one of the first to fourth aspects in which refrigerant is water. In other words, the refrigerant liquid stored in the evaporator is water. Since water has large latent heat of vaporization, the amount of refrigerant vapor that is generated in the intercooler is decreased. This makes it possible to cool refrigerant vapor so that the refrigerant vapor sucked into the second compressor is at the saturation temperature or a temperature in the neighborhood of the saturation temperature while reducing the work to be done by the second compressor. As a result, the refrigeration cycle apparatus according to the fifth aspect can achieve high COP.

Embodiments of the present disclosure are now described with reference to drawings. The following embodiments are provided only for illustrative purpose and are not intended to limit the present disclosure.

First Embodiment

As shown in FIG. 1, a refrigeration cycle apparatus 1*a* includes an evaporator 2, a first compressor 3, an intercooler 4, a second compressor 5, a condenser 6, and a refrigerant liquid supply passage 7. The evaporator 2 stores a refrigerant liquid and also evaporates the refrigerant liquid to generate a refrigerant vapor. The first compressor 3 sucks in the refrigerant vapor generated in the evaporator 2 and compresses it. The intercooler 4 stores refrigerant liquid and also receives and cools the refrigerant vapor compressed by the first compressor 3 and expels it. The intercooler 4 makes the refrigerant liquid stored in the intercooler 4 directly contact the refrigerant vapor received into the intercooler 4 to cool the refrigerant vapor. The second compressor 5 sucks in the refrigerant vapor expelled from the intercooler 4 and compresses it. The condenser 6 sucks in the refrigerant vapor compressed by the second compressor 5 and condenses it to generate a refrigerant liquid. The condenser 6 stores the refrigerant liquid generated in the condenser 6 and discharges a part of the refrigerant liquid. The refrigerant liquid supply passage 7 is a passage in which the refrigerant liquid discharged from the condenser 6 flows and that supplies refrigerant liquid to the evaporator 2.

The intercooler 4 includes a container 4*a*, an intercooling passage 4*b* (a first passage), and a pump 4*c*. The container 4*a* contains a vapor space 41 for receiving refrigerant vapor and also stores refrigerant liquid. The intercooling passage 4*b* is a passage in which a part of the refrigerant liquid stored in the container 4*a*, rather than the refrigerant liquid stored in the evaporator 2, flows and that supplies the part of the refrigerant liquid to the vapor space 41. The pump 4*c* is disposed on the intercooling passage 4*b* and pumps a part of the refrigerant liquid stored in the container 4*a* to the vapor space 41.

The refrigeration cycle apparatus 1*a* contains a single kind of refrigerant. The refrigerant to be contained in the refrigeration cycle apparatus 1*a* may be a fluorocarbon refrigerant such as hydrochlorofluorocarbon (HCFC) and hydrofluorocarbon (HFC), a refrigerant with a low global warming potential such as HFO-1234yf, and a natural refrigerant such as $CO_2$ and water. The refrigerant for the refrigeration cycle apparatus 1*a* is preferably water. Since water has large latent heat of vaporization, the amount of refrigerant vapor to be generated can be advantageously decreased. For example, as the amount of refrigerant vapor generated in the intercooler 4 is reduced, the work to be done by the second compressor 5 can be advantageously decreased.

The operation of the refrigeration cycle apparatus 1*a* will be described by illustrating a case where the refrigerant is water. The evaporator 2 is a heat exchanger that evaporates refrigerant liquid through heat input to the refrigerant liquid stored in the evaporator 2. The evaporator 2 may be built as a direct heat exchanger or an indirect heat exchanger that effects heat exchange via heat transmitting surfaces formed of components such as fins, for example. The evaporator 2 may be connected with an external endothermic heat exchanger that generates heat load, for example. In this case, the channel for refrigerant liquid would be formed so that refrigerant liquid stored in the evaporator 2 passes through the external endothermic heat exchanger and then returns to the evaporator 2, for example. The temperature of the refrigerant vapor generated in the evaporator 2 is 5° C., for example.

The refrigerant vapor generated in the evaporator 2 is compressed in two stages at the first compressor 3 and the second compressor 5. The first compressor 3 and the second compressor 5 may be either positive displacement compressors or dynamic compressors. A positive displacement compressor refers to a compressor that compresses refrigerant vapor by changing its volume, while a dynamic compressor refers to a compressor that compresses refrigerant by giving it a momentum. The first compressor 3 and the second compressor 5 may each have a mechanism for varying the number of revolutions with a motor driven by an inverter. The compression ratios of the first compressor 3 and the second compressor 5 are not limited to particular values but may be adjusted as appropriate. The first compressor 3 and the second compressor 5 may have the same compression ratio. The temperature of the refrigerant vapor expelled from the first compressor 3 is 120° C., for example.

The refrigerant vapor compressed by the first compressor 3 is received into the intercooler 4 and cooled in the intercooler 4. The intercooler 4 is built as a direct heat exchanger that makes refrigerant liquid directly contact the refrigerant vapor. The inlet of the intercooling passage 4*b* adjoins the space in which refrigerant liquid is stored within the internal space of the container 4*a*. The outlet of the intercooling passage 4*b* adjoins the vapor space 41 of the container 4*a*. By the action of the pump 4*c*, the refrigerant liquid stored in the container 4*a* of the intercooler 4 flows through the intercooling passage 4*b* to be expelled into the vapor space 41 of the container 4*a*. Here, the refrigerant liquid is sprayed in the form of mist into the vapor space 41 of the container 4*a*, for example. This causes the refrigerant liquid to directly contact refrigerant vapor in the vapor space 41 so that the refrigerant liquid evaporates. Evaporation of the refrigerant liquid cools the refrigerant vapor in the vapor space 41. Also, the refrigerant vapor is expelled to outside the intercooler 4 from the vapor space 41 toward the second compressor 5. The temperature of the refrigerant liquid stored in the container 4*a* of the intercooler 4 is 21° C., for example. The temperature of the refrigerant vapor expelled from the intercooler 4 is 23° C., for example.

The pump 4*c* may be either a positive displacement pump or a dynamic pump. A positive displacement pump refers to a pump that increases the pressure of refrigerant liquid by changing its volume, while a dynamic pump refers to a pump that increases the pressure of refrigerant liquid by giving the refrigerant a momentum. The pump 4*c* may have a mechanism for varying the number of revolutions of the pump 4*c*, such as a motor driven by an inverter. The discharge pressure of the pump 4*c* may be 100 to 1000 kPa, for example, without being limited to a particular value.

The refrigerant vapor expelled from the intercooler 4 is sucked into the second compressor 5 and compressed therein, and expelled from the second compressor 5. The temperature of the refrigerant vapor expelled from the second compressor 5 is 120° C., for example.

The refrigerant vapor expelled from the second compressor 5 is sucked into the condenser 6. The condenser 6 condenses the sucked refrigerant vapor by dissipating the heat of the refrigerant vapor to generate refrigerant liquid. The condenser 6 may be built as a direct heat exchanger or an indirect heat exchanger that effects heat exchange via heat transmitting surfaces formed of components such as fins, for example. The condenser 6 may be connected with an external radiation heat exchanger that generates heat load, for example. In this case, the channel for refrigerant liquid would be formed so that refrigerant liquid stored in the condenser 6 passes through the external radiation heat exchanger and then returns to the condenser 6, for example. The temperature of the refrigerant liquid generated in the condenser 6 is 35° C., for example. A part of the refrigerant liquid generated in the condenser 6 is discharged.

The refrigerant liquid discharged from the condenser 6 is supplied to the evaporator 2 through the refrigerant liquid supply passage 7. In this manner, refrigerant liquid is discharged from the condenser 6 and supplied to the evaporator 2 so as to replenish refrigerant liquid reduced due to evaporation of refrigerant liquid in the evaporator 2 and so that refrigerant liquid does not increase too much in the condenser 6 due to condensation of refrigerant vapor in the condenser 6. Refrigerant circulates in the refrigeration cycle apparatus 1*a* through the refrigerant vapor channel running from the evaporator 2 via the first compressor 3, the intercooler 4, and the second compressor 5 to the condenser 6, and through the refrigerant liquid supply passage 7. The refrigerant liquid supply passage 7 may be equipped with a flow rate regulation mechanism, such as a flow rate regulation valve, for adjusting the mass flow rate of refrigerant liquid discharged from the condenser 6, that is, the mass flow rate of refrigerant liquid supplied to the evaporator 2. The flow rate regulation valve may be a motor operated valve with a variable opening degree, for example. As shown in FIG. 1, the refrigerant liquid supply passage 7 is formed as a single channel having one end connected to the condenser 6 and the other end connected to the evaporator 2, for example.

The refrigerant liquid stored in the container 4*a* of the intercooler 4 takes on the saturation temperature at the pressure of the refrigerant vapor received in the intercooler 4 due to phase change of refrigerant caused by the difference between the saturation pressure of the refrigerant liquid and the pressure of refrigerant vapor received in the intercooler 4. The refrigerant liquid stored in the container 4*a* of the intercooler 4 flows through the intercooling passage 4*b* by the action of the pump 4*c* and is expelled to the vapor space 41, in which the refrigerant liquid makes direct contact with the superheated refrigerant vapor expelled from the first compressor 3. The refrigerant vapor is thereby cooled and the refrigerant liquid evaporates due to the heat of the refrigerant vapor. Refrigerant vapor resulting from the evaporation of refrigerant liquid is sucked into the second compressor 5. Thus, the refrigerant liquid stored in the container 4*a* of the intercooler 4 is kept at the saturation temperature. Since the operation of the intercooler 4 does not increase the amount of vapor generated in the evaporator 2, the work to be done by the first compressor 3 can be prevented from increasing. The intercooler 4 is also capable of cooling refrigerant vapor so that the refrigerant vapor sucked into the second compressor 5 is at the saturation temperature or a temperature in the neighborhood of the saturation temperature. As a result, the refrigeration cycle apparatus 1*a* can achieve high COP.

As a comparative example, consider a refrigeration cycle apparatus that is built similarly to the refrigeration cycle apparatus 1*a* except for having channels A and B in place of the intercooling passage 4*b*. The channel A is a channel for supplying the refrigerant liquid stored in the evaporator 2 to the container 4*a* of the intercooler 4 for cooling refrigerant vapor received into the intercooler 4, and channel B is a channel for sending the refrigerant liquid stored in the container 4*a* back to the evaporator 2. Assume also that the power necessary for the operation of the refrigeration cycle apparatus 1*a* is 30 kW. In the refrigeration cycle apparatus as the comparative example, the amount of refrigerant vapor generated in the evaporator 2 increases. This leads to an increase of 0.68 kW in the work to be done by the first compressor 3 of the refrigeration cycle apparatus as the comparative example compared to the refrigeration cycle apparatus 1*a*, for example. In contrast, the power necessary for the operation of the pump 4*c* in the refrigeration cycle apparatus 1*a* is 0.20 kW at most, for example. Thus, the refrigeration cycle apparatus 1*a* can decrease the power required for the operation of the apparatus by 0.48 kW (=0.68 kW−0.20 kW) relative to the refrigeration cycle apparatus as the comparative example. This reduction of the required power accounts for as much as 1.6% of the power required for the operation of the refrigeration cycle apparatus 1*a*. The refrigeration cycle apparatus 1*a* thus can achieve high COP.

Second Embodiment

A refrigeration cycle apparatus 1*b* according to a second embodiment is built similarly to the refrigeration cycle apparatus 1*a* unless otherwise specifically noted. Components of the refrigeration cycle apparatus 1*b* that are the same as or correspond to ones of the refrigeration cycle apparatus 1*a* are denoted with the same reference characters and are not described in detail again. Descriptions relating to the refrigeration cycle apparatus 1*a* also apply to the refrigeration cycle apparatus 1*b* unless they are technically inconsistent.

Figure 2:
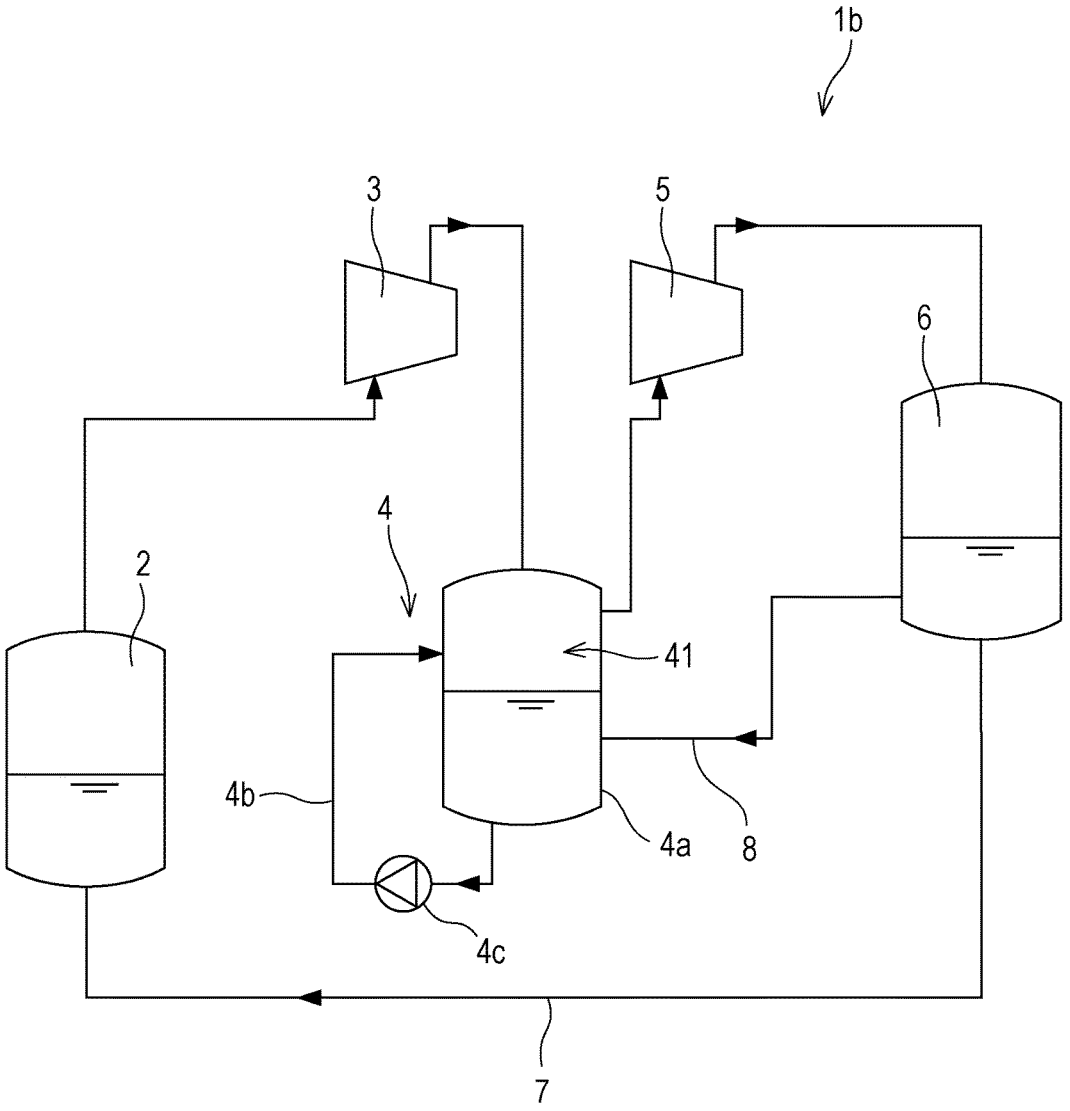
FIG. 2 shows the configuration of the refrigeration cycle apparatus according to a second embodiment.

As shown in FIG. 2, the refrigeration cycle apparatus 1*b* further includes a replenishing channel 8. The replenishing channel 8 is a channel in which a part of the refrigerant liquid stored in the condenser 6 flows and that supplies it into the container 4*a*. The inlet of the replenishing channel 8 adjoins a space in the condenser 6 in which refrigerant liquid is stored. The outlet of the replenishing channel 8 adjoins the inner space of the container 4*a* of the intercooler 4. The replenishing channel 8 may be equipped with a flow rate regulation mechanism, such as a flow rate regulation valve, for adjusting the mass flow rate of refrigerant liquid supplied from the condenser 6 to the intercooler 4.

The refrigerant liquid stored in the container 4*a* of the intercooler 4 evaporates by contacting the superheated refrigerant vapor expelled from the first compressor 3 and is expelled from the intercooler 4 and sucked into the second compressor 5. Thus, in the refrigeration cycle apparatus 1*a*, the refrigerant liquid stored in the container 4*a* of the intercooler 4 decreases as the operation continues. Due to the presence of the replenishing channel 8 in the refrigeration cycle apparatus 1*b*, however, the refrigerant liquid stored in the condenser 6 is supplied to the container 4*a* of the intercooler 4 through the replenishing channel 8. After being supplied to the container 4*a* of the intercooler 4 through the replenishing channel 8, the refrigerant liquid, which is at high temperature, flash evaporates and separates into refrigerant liquid and refrigerant vapor at the saturation temperature within the container 4*a* of the intercooler 4. Refrigerant vapor resulting from the flash evaporation of the hot refrigerant liquid is expelled from the intercooler 4 and sucked into the second compressor 5. This can prevent shortage of the amount of refrigerant liquid stored in the container 4*a* of the intercooler 4 while avoiding increase of the work to be done by the first compressor 3. Thus, refrigerant vapor can be cooled so that the refrigerant vapor sucked into the second compressor 5 is at the saturation temperature or a temperature in the neighborhood of the saturation temperature while preventing increase of the work to be done by the first compressor 3 even when the refrigeration cycle apparatus 1*b* is operated for a long period of time. As a result, the refrigeration cycle apparatus 1*b* can achieve high COP.

Third Embodiment

A refrigeration cycle apparatus 1*c* according to a third embodiment is built similarly to the refrigeration cycle apparatus 1*a* unless otherwise specifically noted. Components of the refrigeration cycle apparatus 2*c* that are the same as or correspond to ones of the refrigeration cycle apparatus 1*a* are denoted with the same reference characters and are not described in detail again. Descriptions relating to the refrigeration cycle apparatus 1*a* also apply to the refrigeration cycle apparatus 1*c* unless they are technically inconsistent.

Figure 3:
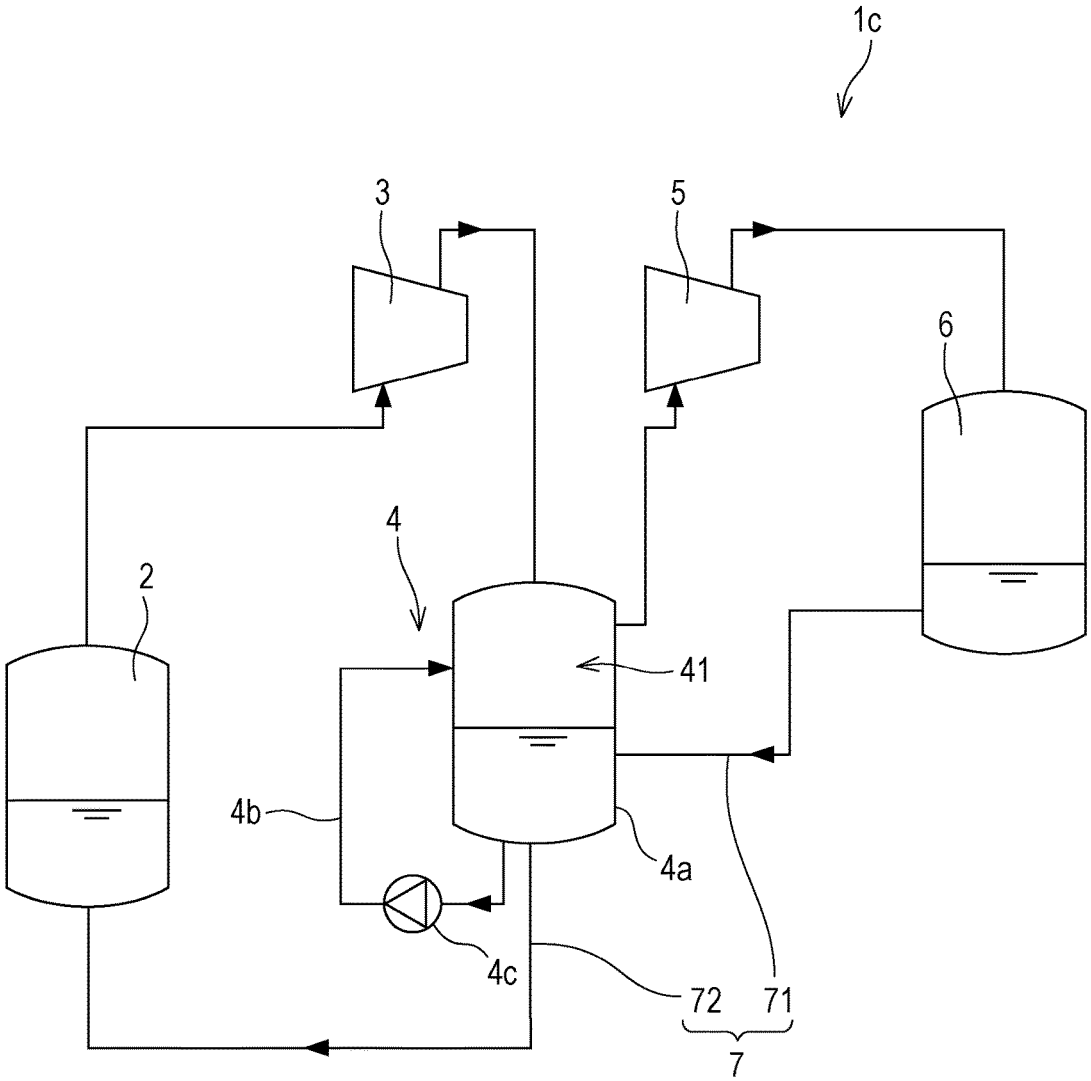
FIG. 3 shows the configuration of the refrigeration cycle apparatus according to a third embodiment.

As shown in FIG. 3, the refrigerant liquid supply passage 7 of the refrigeration cycle apparatus 1*c* includes a first refrigerant channel 71 and a second refrigerant channel 72. The first refrigerant channel 71 is a channel in which refrigerant liquid discharged from the condenser 6 flows and that supplies the refrigerant liquid into the container 4*a*. The second refrigerant channel 72 is a channel in which a part of the refrigerant liquid stored in the container 4*a* flows and that supplies the part of the refrigerant liquid to the evaporator 2. The inlet of the first refrigerant channel 71 adjoins a space in the condenser 6 in which the refrigerant liquid is stored, while the outlet of the first refrigerant channel 71 adjoins the inner space of the container 4*a*. The inlet of the second refrigerant channel 72 adjoins a space in the container 4*a* in which the refrigerant liquid is stored, while the outlet of the second refrigerant channel 72 adjoins the inner space of the evaporator 2.

Refrigerant liquid discharged from the condenser 6 is supplied into the container 4*a* of the intercooler 4 through the first refrigerant channel 71. This causes the refrigerant liquid supplied from the condenser 6 into the container 4*a* of the intercooler 4 to flash evaporate and separate into refrigerant liquid and refrigerant vapor at the saturation temperature. The first refrigerant channel 71 may be equipped with a flow rate regulation mechanism, such as a flow rate regulation valve, for adjusting the mass flow rate of refrigerant liquid discharged from the condenser 6 and supplied to the intercooler 4.

A part of the refrigerant liquid stored in the container 4*a* of the intercooler 4 passes through the second refrigerant channel 72 and is supplied to the evaporator 2. The refrigerant liquid stored in the container 4*a* of the intercooler 4 contains refrigerant liquid that has been discharged from the condenser 6 and supplied to the intercooler 4. Accordingly, refrigerant liquid supplied to the evaporator 2 on the second refrigerant channel 72 contains refrigerant liquid discharged from the condenser 6. The second refrigerant channel 72 may be equipped with a flow rate regulation mechanism, such as a flow rate regulation valve, for adjusting the mass flow rate of refrigerant liquid supplied from the container 4*a* of the intercooler 4 to the evaporator 2.

The container 4*a* of the intercooler 4 stores refrigerant liquid having the saturation temperature at an intermediate pressure equivalent to the pressure of the refrigerant vapor expelled from the first compressor 3. This refrigerant liquid at the saturation temperature at the intermediate pressure is supplied to the evaporator 2 through the second refrigerant channel 72. Accordingly, the enthalpy of the refrigerant liquid supplied to the evaporator 2 decreases by the difference between the enthalpy of the refrigerant liquid stored in the condenser 6 and the enthalpy of the refrigerant liquid stored in the container 4*a* of the intercooler 4, so that the amount of refrigerant vapor that is generated in the evaporator 2 decreases. This also decreases the amount of superheated refrigerant vapor expelled from the first compressor 3 and received into the intercooler 4 as well as the amount of refrigerant vapor that is generated by cooling the superheated refrigerant vapor in the intercooler 4. Thus, the work to be done by the first compressor 3 as well as the work to be done by the second compressor 5 can be reduced. Meanwhile, the intercooler 4 can cool refrigerant vapor so that the refrigerant vapor sucked into the second compressor 5 is at the saturation temperature or a temperature in the neighborhood of the saturation temperature. As a result, the refrigeration cycle apparatus 1*c* can achieve high COP.

Fourth Embodiment

A refrigeration cycle apparatus 1*d* according to a fourth embodiment is built similarly to the refrigeration cycle apparatus 1*c* unless otherwise specifically noted. Components of the refrigeration cycle apparatus 1*d* that are the same as or correspond to ones of the refrigeration cycle apparatus 1*c* are denoted with the same reference characters and are not described in detail again. Descriptions relating to the refrigeration cycle apparatuses 1*a* and 1*c* also apply to the refrigeration cycle apparatus 1*d* unless they are technically inconsistent.

Figure 4:
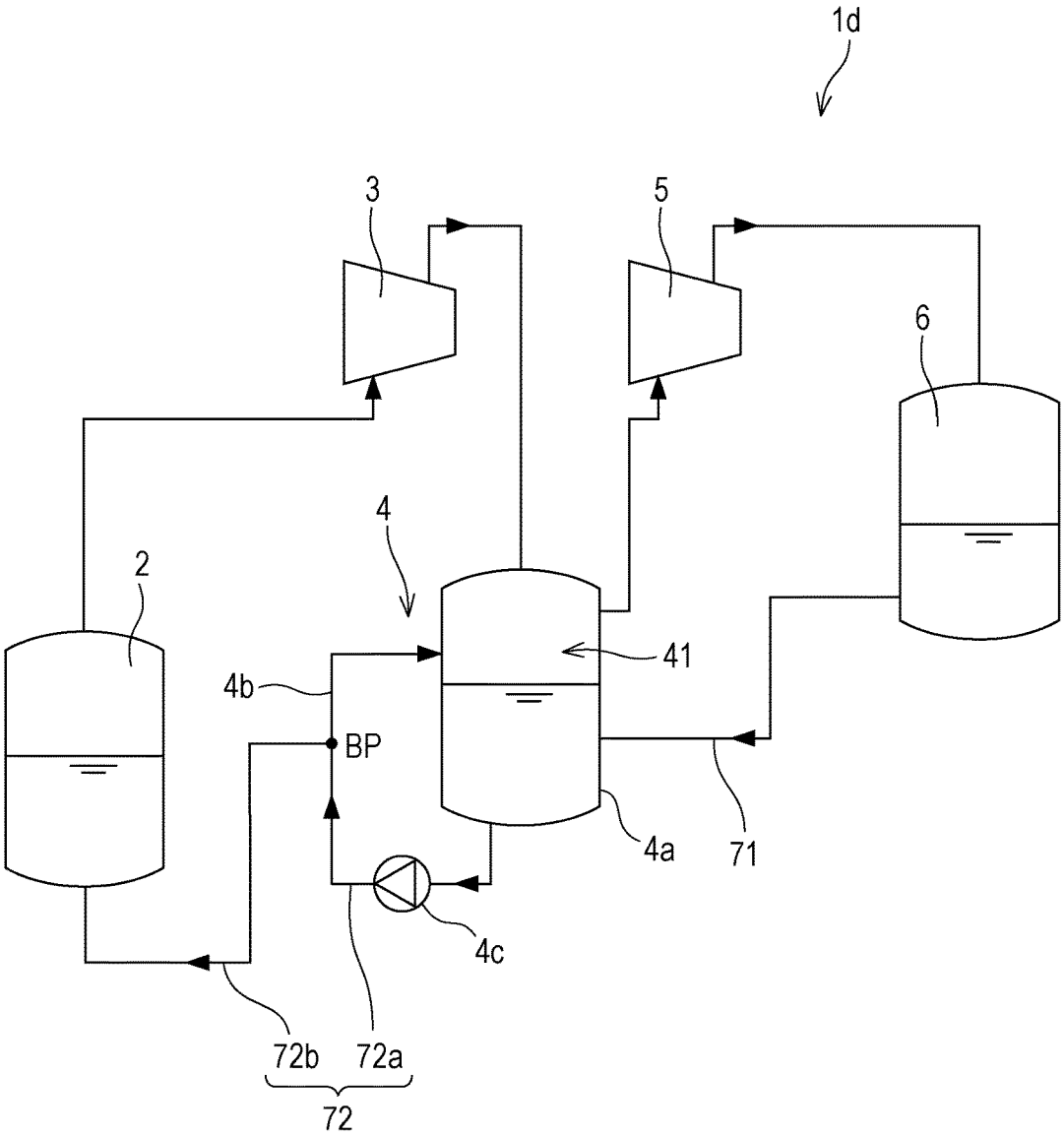
FIG. 4 shows the configuration of the refrigeration cycle apparatus according to a fourth embodiment.
Figure 5:
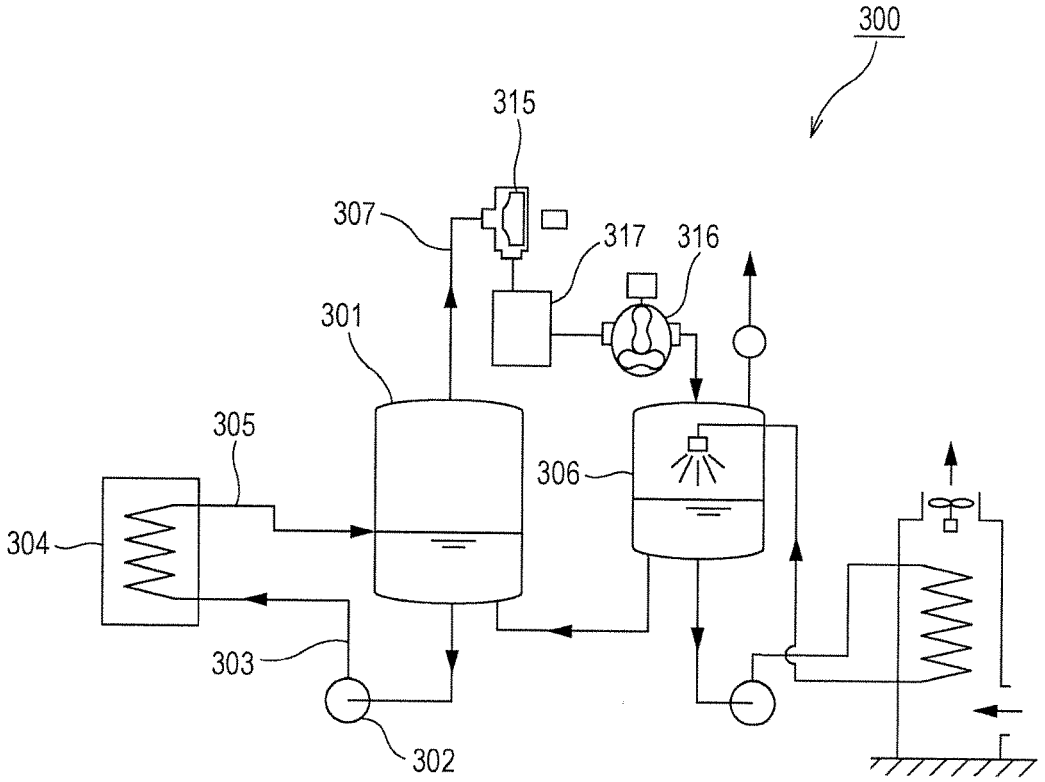
FIG. 5 (Prior Art)
FIG. 5 shows the configuration of a conventional evaporative refrigeration apparatus.

As shown in FIG. 4, the second refrigerant channel 72 of the refrigeration cycle apparatus 1*d* includes an upstream channel 72*a* and a downstream channel 72*b*. The upstream channel 72*a* is formed of a portion of the intercooling passage 4*b* which extends from the inlet (a first portion) of the intercooling passage 4*b* to a branching point BP located between the discharge port of the pump 4*c* and the outlet (a second portion) of the intercooling passage 4*b*. The downstream channel 72*b* is a channel in which a part of the refrigerant liquid flowing on the intercooling passage 4*b* from the branching point BP flows and that supplies the part of the refrigerant liquid to the evaporator 2. The inlet of the downstream channel 72*b* is located at the branching point BP, and the outlet of the downstream channel 72*b* adjoins the inner space of the evaporator 2.

By the action of the pump 4*c*, a part of the refrigerant liquid stored in the container 4*a* of the intercooler 4 flows through the upstream channel 72*a* to reach the branching point BP. A part of the refrigerant liquid that has reached the branching point BP flows from the branching point BP toward the outlet of the intercooling passage 4*b* to be directed to the vapor space 41. The remaining portion of the refrigerant liquid that has reached the branching point BP passes through the downstream channel 72*b* and is supplied to the evaporator 2. The velocity of the refrigerant liquid that is supplied to the evaporator 2 through the downstream channel 72*b* is determined by the difference between the discharge pressure of the pump 4*c* and the pressure at the outlet of the downstream channel 72*b*.

For example, when the load on the evaporator 2 is low and the amount of heat absorption in the evaporator 2 is small, the difference between the pressure of refrigerant vapor received into the container 4*a* of the intercooler 4 and the pressure of refrigerant vapor inside the evaporator 2 becomes small. Even in such a situation, refrigerant liquid can still be stably supplied to the evaporator 2 by the action of the pump 4*c* as the upstream channel 72*a* of the refrigeration cycle apparatus 1*d* is formed of a portion of the intercooling passage 4*b* including the pump 4*c*. Thus, the work to be done by the first compressor 3 as well as the work to be done by the second compressor 5 can be reduced even when the amount of heat absorption in the evaporator 2 is small. Additionally, the intercooler 4 can cool refrigerant vapor so that the refrigerant vapor sucked into the second compressor 5 is at the saturation temperature or a temperature in the neighborhood of the saturation temperature. As a result, the refrigeration cycle apparatus 1*d* can achieve high COP.

The refrigeration cycle apparatuses according to the present disclosure can be utilized as air conditioners, chillers, heat storage devices, and the like, and can be advantageously utilized as air conditioners for household and business uses in particular.

What is claimed is:

1. A refrigeration cycle apparatus comprising:

an evaporator that stores a refrigerant liquid and that evaporates the refrigerant liquid to generate a refrigerant vapor, the refrigerant liquid being a refrigerant in a liquid phase, the refrigerant vapor being the refrigerant in a vapor phase;

a first compressor that compresses the refrigerant vapor generated in the evaporator;

an intercooler that cools the refrigerant vapor compressed by the first compressor;

a passage connecting the first compressor and the intercooler;

a second compressor that compresses the refrigerant vapor cooled by the intercooler;

a condenser that condenses the refrigerant vapor compressed by the second compressor to generate a refrigerant liquid and that stores the refrigerant liquid generated in the condenser; and a refrigerant liquid supply passage in which the refrigerant liquid stored in the condenser flows from the condenser to the evaporator, wherein:

the intercooler includes:

a container that contains a vapor space therein for receiving the refrigerant vapor compressed by the first compressor and that stores a refrigerant liquid;

an intercooling passage in which a part of the refrigerant liquid stored in the container flows and that supplies the part of the refrigerant liquid stored in the container to the vapor space; and a pump that is disposed on the intercooling passage and that pumps the part of the refrigerant liquid stored in the container and expels the part of the refrigerant liquid into the vapor space, such that the expelled refrigerant liquid directly contacts the refrigerant vapor compressed by the first compressor in the vapor space, and the passage connecting the first compressor and the intercooler connects the first compressor and the vapor space of the container such that the refrigerant vapor compressed by the first compressor is expelled into the vapor space.

2. The refrigeration cycle apparatus according to claim 1, further comprising:

a replenishing channel in which a part of the refrigerant liquid stored in the condenser flows and that supplies the part of the refrigerant liquid stored in the condenser into the container.

3. The refrigeration cycle apparatus according to claim 1, wherein the refrigerant liquid supply passage includes a first refrigerant channel in which the refrigerant liquid discharged from the condenser flows and that supplies the refrigerant liquid discharged from the condenser into the container, and a second refrigerant channel in which a part of the refrigerant liquid stored in the container flows and that supplies the part of the refrigerant liquid to the evaporator.

4. The refrigeration cycle apparatus according to claim 3, wherein the second refrigerant channel includes an upstream channel that is formed of a portion of the intercooling passage which extends from an inlet of the intercooling passage to a branching point located between a discharge port of the pump and an outlet of the intercooling passage, and a downstream channel in which a part of the refrigerant liquid flowing on the intercooling passage from the branching point flows and that supplies the part of the refrigerant liquid to the evaporator.

5. The refrigeration cycle apparatus according to claim 1, wherein the refrigerant is water.

6. The refrigeration cycle apparatus according to claim 1, wherein the intercooling passage is located outside the container and connects a first port of the container with a second port of the container, the first port being in contact with the refrigerant liquid, and the second port being located above the first portion in the gravity direction and being in contact with the vapor space, and the pump is disposed on the intercooling passage between the first port and the second port and pumps the refrigerant liquid from the first port toward the second port.

7. The refrigeration cycle apparatus according to claim 6, wherein the intercooling passage directly connect the first port and the second port.

8. The refrigeration cycle apparatus according to claim 1, wherein the container encloses the vapor space for receiving the refrigerant vapor compressed by the first compressor and not compressed by the second compressor.

* * * * *